United States Patent [19]

Korta

[11] 4,139,329

[45] Feb. 13, 1979

[54] VANE TIP MOTION TRANSFER DEVICE

[75] Inventor: John Korta, Stoney Creek, Canada

[73] Assignee: Westinghouse Canada Limited, Hamilton, Canada

[21] Appl. No.: 797,121

[22] Filed: May 16, 1977

[51] Int. Cl.[2] ..... F01D 17/16; F01D 1/04; F01D 9/04

[52] U.S. Cl. ..... 415/161; 415/191; 415/217; 74/96

[58] Field of Search ..... 415/159, 160, 161, 162, 415/191, 193, 217, 218; 74/96

[56] References Cited

U.S. PATENT DOCUMENTS

| | | | |
|---|---|---|---|
| 3,538,579 | 11/1970 | Sprenger | 415/160 |
| 3,788,763 | 1/1974 | Nickles | 415/160 X |
| 3,999,883 | 12/1976 | Nordenson | 415/160 X |

FOREIGN PATENT DOCUMENTS

| | | | |
|---|---|---|---|
| 2250559 | 4/1974 | Fed. Rep. of Germany | 415/160 |

*Primary Examiner*—Carlton R. Croyle
*Assistant Examiner*—Donald S. Holland
*Attorney, Agent, or Firm*—R. H. Fox; E. H. Oldham

[57] ABSTRACT

This invention relates to a device which is capable of accurately transferring a rotating movement from a master control to a pivotal vane tip in a gas turbine engine. A series of stationary vanes which are housed inside the casing of a gas turbine are each provided with a trailing rotatable vane tip. The device to which this application is directed is mounted on the casing of the gas turbine in a sealed manner and is connected to the rotatable vane tip. The vane tip is continuously biased in a radially outward direction by the motion transfer device to assure the best possible seal of the vane tip in the turbine. Provision is made to allow the vane tip to have some radial flexibility to prevent binding of the vane tip under thermal cycling stresses.

2 Claims, 5 Drawing Figures

50
394
320
309
306
303
304
302
300
350
84
84
64
372
102
26
48
42
44
24
46

VANE TIP MOTION TRANSFER DEVICE

CROSS REFERENCE TO RELATED APPLICATIONS

U.S. application Ser. No. 697,021, filed June 17, 1976, in the name of John Korta, entitled Adjustable Vane Assembly For a Gas Turbine.

U.S. application Ser. No. 694,926, filed June 11, 1976, in the names of John Korta, Arthur W. Upton, John Danko and Azizullah, entitled Cooling Apparatus for a Bearing in a Gas Turbine now abandoned.

U.S. application Ser. No. 694,928, filed June 17, 1976, in the name of John Korta, entitled Vane Rotator Assembly for a Gas Turbine, now abandoned.

U.S. application Ser. No. 697,060, filed June 17, 1976, in the name of John Korta and Water R. Ward, entitled Cooling Apparatus for Split Shaft Gas Turbine now U.S. Pat. No. 4,034,558.

BACKGROUND OF THE INVENTION

Gas turbine engines having a row of adjustable vanes have been built in the past and problems have sometimes been encountered in the operation of the adjusting mechanism during turbine operation. Because the turbine is subjected to widely varying differences in temperature between start of the run conditions, there is substantial expansion of the turbine casing and the members mounted thereto during the thermal cycles encountered. Turbines which have provided adjustable vanes in the past have encountered some difficulty in the operation of the mechanical device used to adjust the vanes once subjected to thermal stress. In particular, the adjusting device may be subjected to warpage and bending which may result in binding or other similar problems when it is desired to adjust the direction of the vanes during the operation of a turbine.

SUMMARY OF THE INVENTION

This invention overcomes the prior art problems in that a ring assembly is mounted on the turbine casing in such a manner as to be relatively immune to the thermal stresses to which the casing is subjected and provision is further made to allow for expansion of the casing during a startup operation so that most of the thermal expansion to which the casing and associated structural components are subjected is dissipated and is not transferred into the operating mechanism of the adjustment drive. A series of pitman arms are connected between the drive member of each vane rotator. The pitman arms are made so that when the drive member is moved each vane rotator is rotated exactly the same amount. The vane rotators themselves are manufactured in such a manner that the hot gases are sealed into the turbine and at the same time the vane rotator allows a substantial amount of movement between the vane and the rotator itself by its method of coupling. Similarly, the vane rotator is also manufactured to assure that a positive bias is asserted on the vane to assure that it will be positioned in a predetermined location in the turbine structure.

DESCRIPTION OF THE PREFERRED EMBODIMENT OF THE INVENTION

Figure 1:
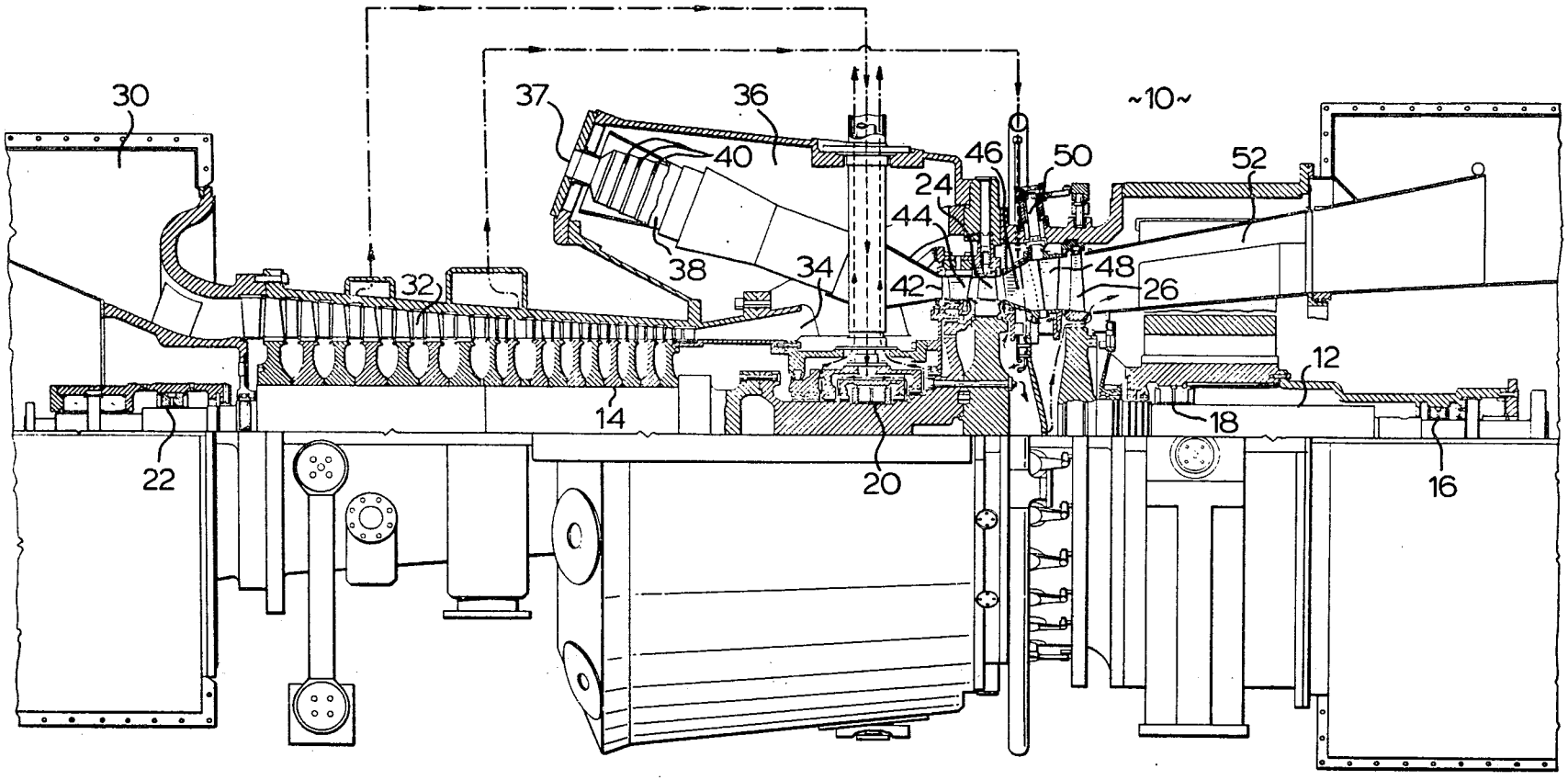
FIG. 1 is a partial sectional view of the gas turbine to which this invention is applied.

Referring now to FIG. 1, it will be seen that a "double shafted" or "split-shaft" turbine 10 is shown, having output power shaft 12 and compressor shaft 14. Power output shaft 12 is journalled in bearings 16 and 18 and compressor shaft 14 is journalled in bearings 20 and 22. Power to drive the compressor section of the compressor turbine is supplied by blades 24. The power blades 26 are provided to drive output shaft 12 to supply power to a load.

As the operation of the complete turbine is fairly obvious to those skilled in the art only a brief description of the overall turbine will be given here.

Air is supplied to intake plenum 30 and is subsequently drawn into the compressor stages 32 and compressed. When the air passes through the last blades of the compressor stage it will have attained a pressure of 90–100 psi. At this time the compressed air is ducted through outlet 34 into the combustor casing 36 of the turbine. Turbine fuel is supplied to fuel inlets 37 of the turbine baskets 38 and the compressed air is passed through passages 40 in baskets 38 where it is mixed with the atomized fuel and is subsequently burned. The hot burning gas passes through the basket outlet 42 and is passed through a set of anti-turbulent vanes 44. The gas then passes through the power blades 24 to drive the compressor section, and the gas exits into another set of stationary vanes 46. It will be seen that a set of movable vanes 48 are shown cooperating with the stationary blades 46. Vanes 48 are provided with intermediate motion transferring device 50 which allow them to pivot through a small angle to provide changes in the duction of the gas passing therethrough. The redirected hot gas thence passes through blades 26 which drive the output shaft 12 to provide output power from the turbine. The hot exhaust gas thence passes into exhaust plenum 52 where it may be ducted to atmosphere or passed through a heat exchanger for purposes of regeneration.

As this disclosure is concerned with the method of pivoting the trailing sections of the stationary vane assembly, it will be convenient to describe the structural details of the gas turbine in this area before the details of the mechanism for rotating the trailing edges of the stationary vanes is discussed.

Figure 2:
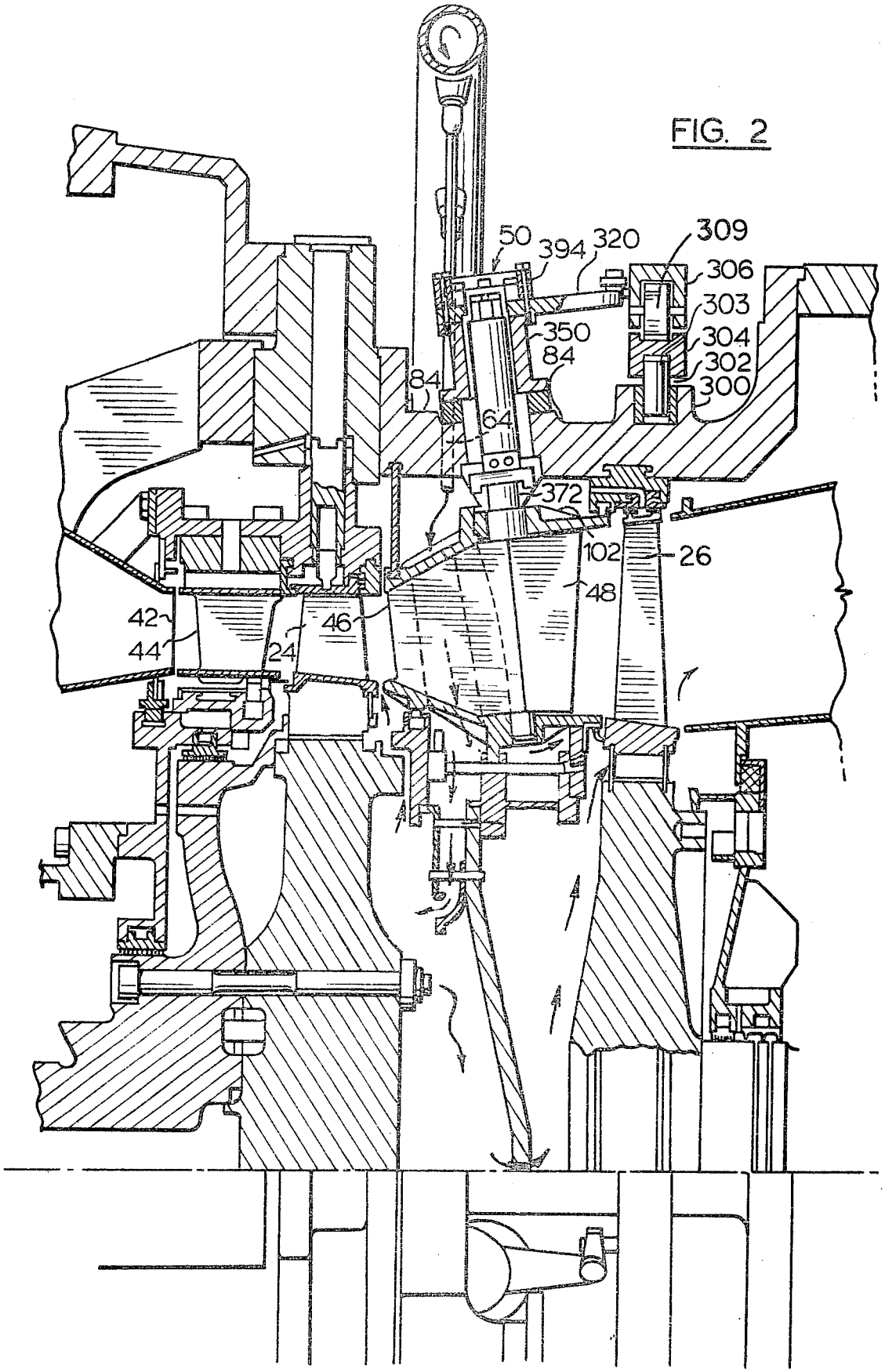
FIG. 2 is a sectional view of the split shaft section of the turbine.
Figure 3:
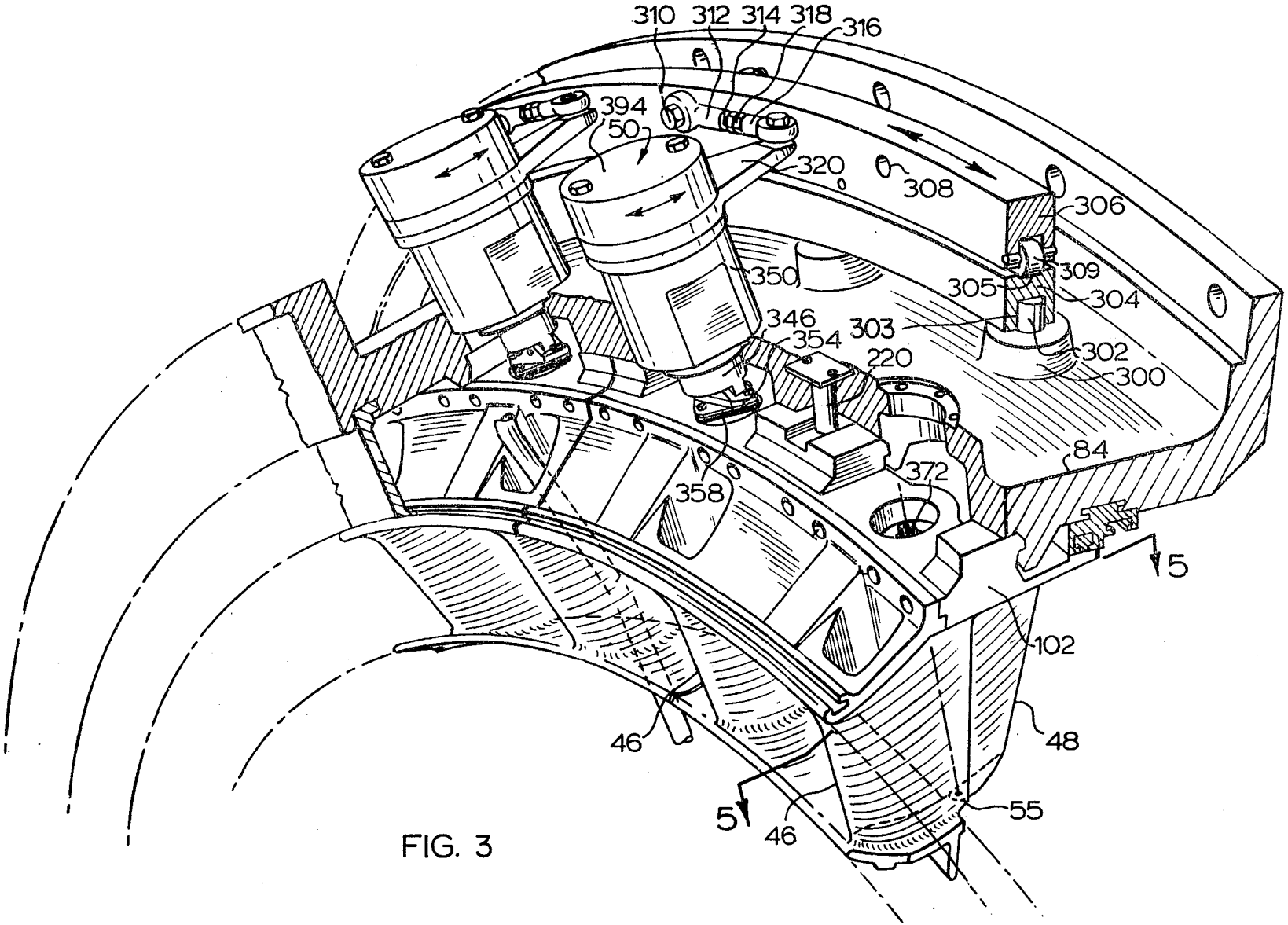
FIG. 3 is a partial sectional perspective view of the vane and actuator section of the turbine.

Referring now to FIGS. 2 and 3, it will be seen that turbine casing 84 provides a support for the operating mechanism for the vane rotators. A series of raised pedestals 300 are shown at spaced intervals around the turbine casing. The pedestals are drilled to receive dowels 302 and the dowels extend into a slot 303 in an annular member 304 to hold the member 304 in axial place above the pedestal 300. The slot in the member 304 is intentionally made to have a greater depth than the length of the dowels 302 to allow for radial expansion of the turbine casing during thermal cycling. A groove 305 is provided on the upper surface of member 304, groove 305 extends completely around member 304. A member 306 which performs the function of a master position control for the vane tips and which is also annular in shape is fitted with rollers 309 to engage the groove 305 in annular member 304 such that member 306 may be conveniently turned about the axis of the turbine with respect to member 304. Member 306 will be provided with a locking means (not shown) which may take the form of a threaded bolt which is threaded through member 306 so as to frictionally engage member 304 and thus prevent any relative motion between members 306 and 304 once the desired position of member 306 is achieved. Annular member 306 is provided with a series of holes 308 to which bolts 310 are provided with a shoulder portion (not shown) to allow them to pivotally receive eye pieces 312. Because of the construction of bolt 310 the bolts may be securely fastened into member 306 without impeding pivotal rotation of eye piece 312 around the bolt. The action of bolt 310 in combination with eye piece 312 will combine to form an anchor pivot for anchoring each pivot rotator assembly to annular member 306. A threaded member 314 is threaded into member 312 and is also threaded into a second eye piece member 316. The threaded member 314 is provided with a pair of lock nuts 318 to prevent any relative movement between the eye pieces and the threaded member 314. Member 316 is provided with a socket at the end thereof to receive a ball joint (not shown) on the member 320 of intermediate motion transferring device 50 to accept eye piece 316. This mechanical joint will be referred to as a pivot joint.

Member 320 (more completely shown in FIG. 4) is provided with a pair of pedestals 322 to which are threaded a pair of studs 324. The studs are arranged to pass into a flat spring washer assembly 326 composed of three metallic spring members which are substantially similar in shape. Nuts 328 serve to bolt the spring assembly to the member 320. A pair of bolts 330 are arranged to pass through the holes 332 and thence through hole 334 in member 326 and subsequently engage nut 336 to couple member 338 to the spring assembly 326. A pair of bolts 340 are arranged to pass through hole 342 and member 338 and subsequently through holes 344 in the cylindrically shaped bolt 346 to intercouple member 338 with member 346. Member 346 is fitted into member 348 in a sliding relationship and member 348 is sealed into member 350 by means of seal 352 and member 348 is arranged to be able to rotate with respect to member 350. Member 346 is coupled to member 354 by means of bolts 356 and member 354 is intercoupled to the spring member 358 in a similar manner as described above with respect to member 326. The fastening of the member 358 to the adjustable vane member 48 will now be described.

Member 48 is provided with a pivot protrusion 371 which is integrally attached to the vane 48. Protrusion 371 is formed of a bearing portion 370 to which integrally attached a spline portion 372. The bearing portion of the vane 370 protrudes into the hole illustrated as 375 on FIG. 3 and the bearing portion 370 is maintained in a sliding rotatable relationship in the hole 375. This allows the spline portion 372 to protrude from the member 102 for attachment into the intermediate motion transferring device 50. A member 374 is provided with a spline section 376 which will conveniently mesh with the spline 372 of the vane 48. A cylindrical member 378 is arranged to slidingly fit into aperture 381 in the member 374 and a bolt 380 is fitted through aperture 382 of member 378 and subsequently be received in the threaded hole 384 in the vane 48. A pair of pins 386 are supplied to pass through holes 388 of the member 374 and subsequently wedge themselves into the provided holes 390 in member 378. Vane 48 is supplied with a second bearing 55 in the member 114 to permit rotation at a second pivot point, with the member 350 is attached to the casing 84 by means of a number of bolts 392 and this effectively seals the member 350 at the casing 84. A cap member 394 is provided with a member of bolts 396 which pass through the member 320 and into the member 348 to seal the entire rotator assembly 50. This means that any gas pressure which is emitted around the member 346 and subsequently passes up into the top most portion of the actuator 50 will be effectively sealed from atmosphere by the presence of cap 394.

The operation of the assembly functions as follows. The annular member 304 is arranged to be fitted on to the casing 84 in a manner which will permit the casing to expand or contract in a radial direction without causing any deflection of the member 304. Member 304 is restrained from rotating axially by suitable means such as a clamp member or a pair of blocking pins situated adjacent a dowel such as the one shown as 302. The master positon control ring 306 is arranged to be able to turn axially about the central axis of the machine and in so doing carry the members 312 and 316 with it to rotate the members 320 on the vane activators 50. It will be seen that adjustment is provided on each of the threaded members 314 to change the relationship of each member 320 with respect to bolts 310. This conveniently allows for the adjustment of each vane in order to be able to provide an initial setting where each vane in the turbine has the same deflection angle. The movement of the member 316 causes rotation of the arm 320 of the member 50. The motion is subsequently transmitted via the spring member 326 to the member 338. The rotation is thus transferred into the cylindrical member 346 which transfers its motion into member 354.

Figure 4:
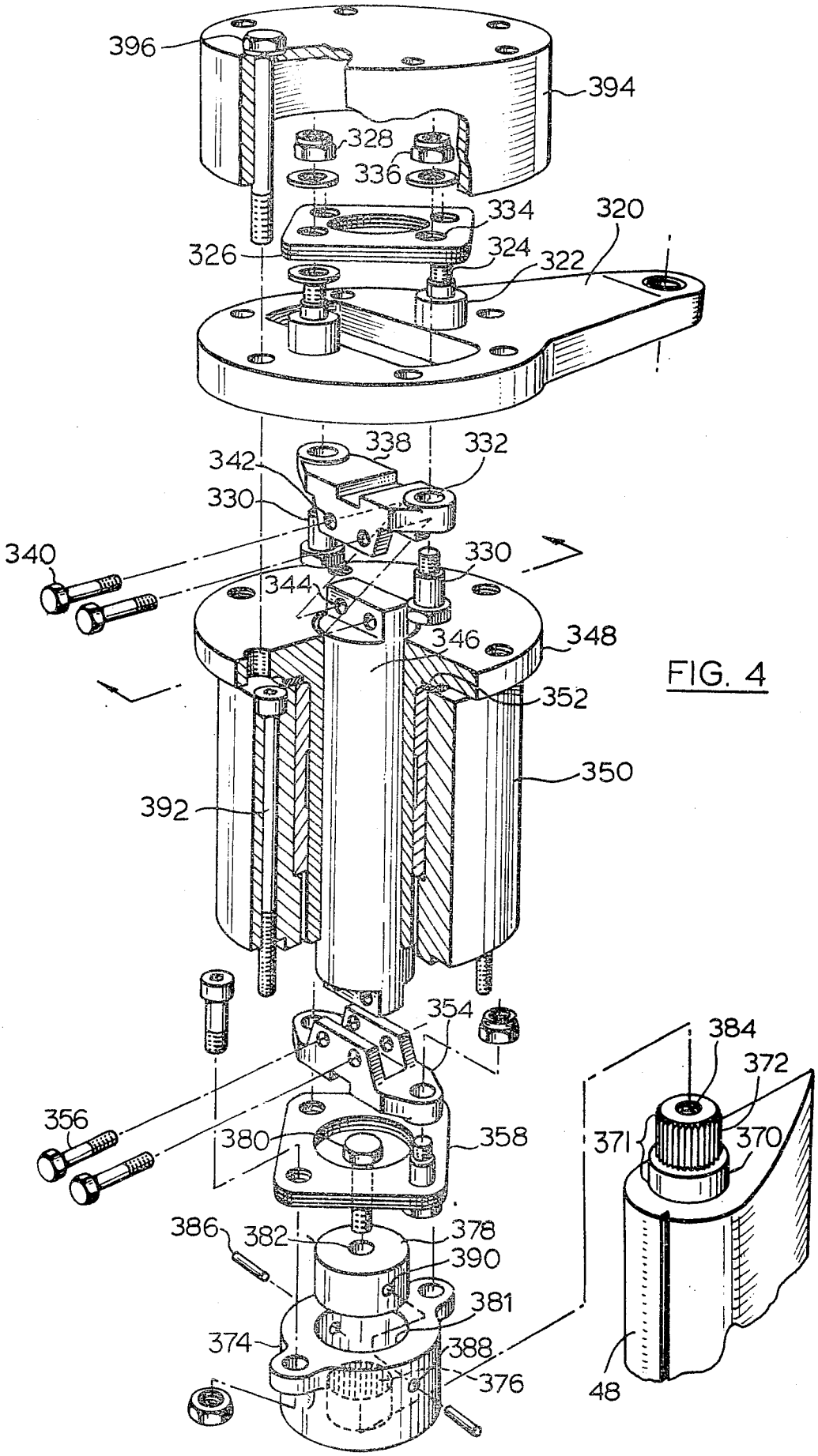
FIG. 4 is an exploded view of the vane rotator of this invention.
Figure 5:
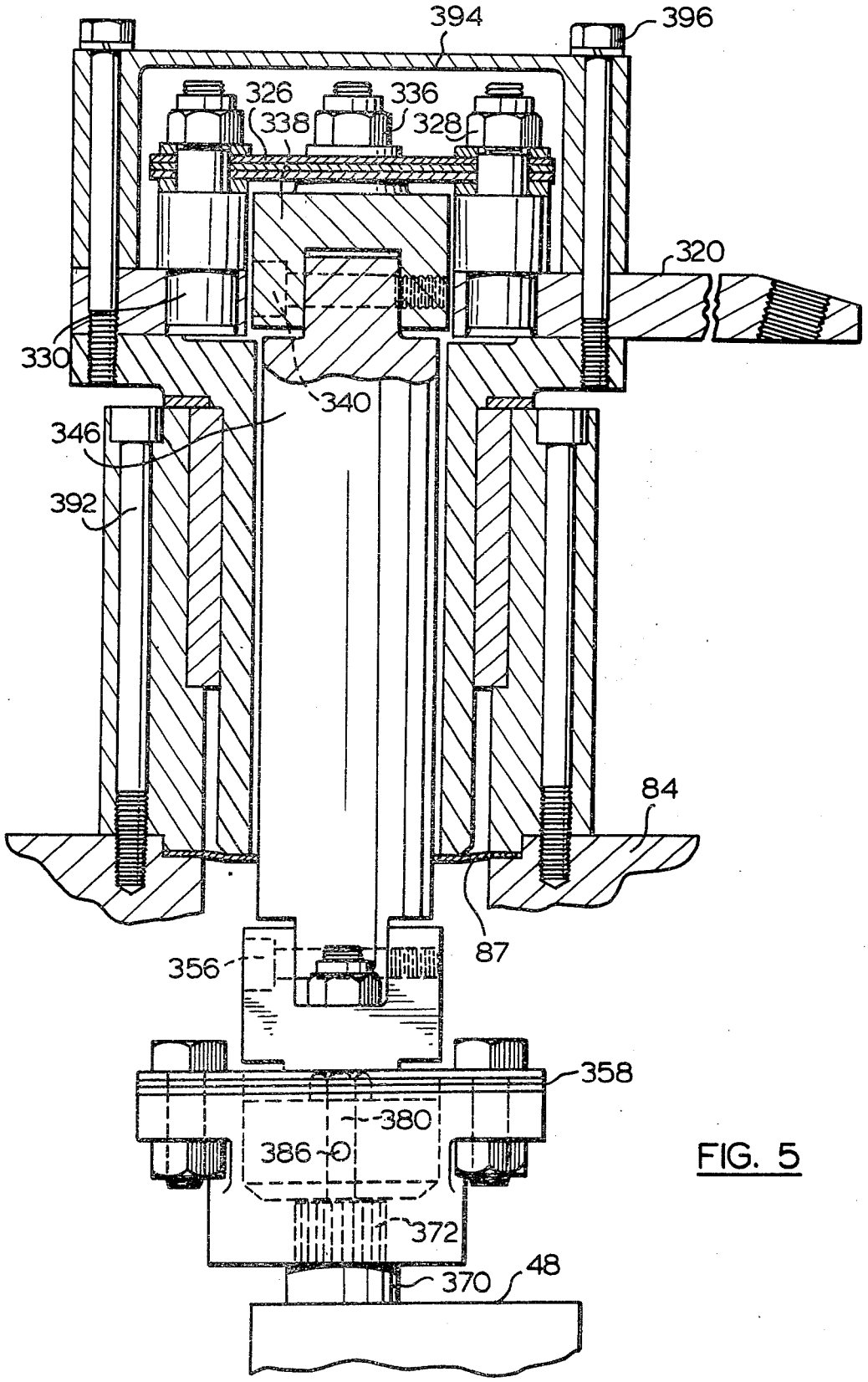
FIG. 5 is a sectional view of the rotator shown in FIG. 4.

Before proceeding further, it will be noted that members 348 and 346 rotate together through exactly the same arc the only difference in the motion of these two pieces will be that member 346 is permitted some freedom to move in a radial direction with respect to casing 84 (which would be in the vertical direction as shown in FIG. 4). It is easily seen that member 348 is restrained from moving in any direction.

Member 354 is connected to member 374 through the spring member 358 and thus the rotation is transferred to member 374. Because of the spline 376, member 374, vane 48 is forced to turn with the rotation provided by member 374. The method of securing member 378 to the blade 48 is one of several methods which could be used. However, for to ease the convenience of assembly, it will be found that this method is probably unexcelled. This method of construction also allows an additional feature to be present in the invention that is, the biasing of the blade 48 outwardly in the machine. This is made possible by the presence of bolt 380 which intercouples member 378 and the top of the spline portion 372 of the vane 48 together. Subsequently, member 374 is keyed by means of pins 386 to the member 378. This method of constuction enables an outward force to be placed on the member 346. The force will be governed by the designer who will be able to preload the member 346 in an outward direction in such a manner that any predetermine amount of deflection of the member 326 and 358 may take place.

It will be seen that member 346 is made in such a manner that a substantial amount of radial movement may take place in the machine and yet the blade 48 will be continued to be biased in an outward direction by the members 326 and 358. It will be seen therefore that this device provides a certain amount of freedom for the casing 84 to move in a radial direction without interferring with the movement of the member 306 to adjust the vanes in the machine. Provision is also made to adjust each of the vanes in such a manner as to enable all the vanes to be facing in the same direction and at the same time some radial motion is permitted between the casing 84 and the member 102 and yet the location of the vane 48 will be still predetermined by the biasing force brought about by the provision of the spring members 326 and 358. Vanes 48 are biased in an outward direction for two reasons: First, if the vanes 48 are mounted freely in the bearings of members 102 and 55, the vanes will vibrate when the hot gas stream undergoes any turbulent flow. This causes premature wear on the bearings of the vanes themselves and the associated mounting structure which can lead to early failure of an associated component. The structure described heretofor avoids this condition by applying a constant force to the movable vanes of the turbine.

Because the vane is biased outwardly, member 348 is biased inwardly in member 350 to maintain a compressive force on seal 352. The bias force provides the necessary pressure to seal the rotator assembly.

Although it is self evident that alternative methods may be used to move and intercouple the trailing vanes 48, the method hereinbefore described provides freedom of adjustment for positioning each vane separately, and permit the entire vane assembly to move together with a minimum of function and backlash.

The embodiments of the invention in which an exclusive property or privilege is claimed are defined as follows:

1. A gas turbine engine having a series of rotatable trailing vane tip members which are suitably connected through the casing of said gas turbine to a series of intermediate motion transferring devices mounted on the exterior of said casing, each of said motion transferring devices being provided with a rotatable lever arm which is connected to a master position control device by a suitable link, each intermediate motion transferring device comprising a cylindraceous body which is sealedly mounted on the casing of said gas turbine, a second cylindraceous member sealedly journalled in said body so as to be rotatable in said body, said second member having an annular flange integrally formed at one end thereof, seal means between said flange and said body to prevent the escape of hot gasses therefrom, a hollow cap member combining with said second member to sealedly sandwich said lever arm therebetween, shaft means passing from said lever arm through said device to said rotatable vane tip, coupling means connected to each end of said shaft means to couple said shaft means to said lever and to said vane tip respectively, said coupling means being resilient to permit substantial relative radial movement of said device with respect to said vane tip while accurately transmitting rotational movement from said lever to said vane tip, said coupling means also supplying a small bias force to urge said vane tip in a radially outward direction.

2. An intermediate motion transfer device for transmitting rotational movement to a rotatable vane tip in a gas turbine engine in which a series of rotatable vane tips are to be simultaneously rotated through the same arc by a common master position control device, said motion transfer device having a cylindraceous body which is sealedly secured to the casing of the gas turbine in a location radially outwardly of said vane tip, a second member of cylindraceous shape being sealedly mounted in said body, but which is rotatable in said body, a lever member sealedly secured to said second member, said lever member being connected to said master position control device by a suitable link, shaft means passing axially through said body and said second member, to interconnect said lever and rotatable vane tip to cause said vane tip to rotate when said lever is rotated, coupling means between said shaft means and said lever and between said shaft means and said vane tip to accurately transfer any rotational movement from the lever to the vane tip via said shaft means and said coupling means, said coupling means being resilient to relative motion in a radial direction so as to permit some relative radial movement between said casing and said vane tip, said coupling means also causing said vane tip to be biased in a radially outward direction.

* * * * *